US005518640A

United States Patent [19]

Rodzewich

[11] Patent Number: 5,518,640

[45] Date of Patent: May 21, 1996

[54] METAL WORKING EMULSION CLEANER

[75] Inventor: Edward A. Rodzewich, Flourtown, Pa.

[73] Assignee: Betz Laboratories, Inc., Trevose, Pa.

[21] Appl. No.: 534,365

[22] Filed: Sep. 27, 1995

Related U.S. Application Data

[63] Continuation-in-part of Ser. No. 276,016, Jul. 15, 1994, abandoned, which is a continuation-in-part of Ser. No. 109,117, Aug. 19, 1993, abandoned.

[51] Int. Cl.[6] ..... C10M 135/10

[52] U.S. Cl. ..... 252/33; 252/49.5; 252/515 R; 252/56 R; 252/117; 134/2

[58] Field of Search ..... 252/49.5, 49.3, 252/33, 117, DIG. 14, 515 R, 56 R; 134/2

[56] References Cited

U.S. PATENT DOCUMENTS

| | | | |
|---|---|---|---|
| 3,630,898 | 12/1971 | Teeter et al. | 252/34.7 |
| 3,634,338 | 1/1972 | Lauble et al. | 252/525 |
| 3,723,162 | 3/1973 | Leontaritis et al. | 117/71 |
| 3,960,742 | 6/1976 | Leonard | 252/90 |
| 3,962,151 | 6/1976 | Dekker | 252/548 |
| 3,981,808 | 9/1976 | McClafin et al. | 252/33.3 |
| 4,136,217 | 1/1979 | Henley | 427/327 |
| 4,260,502 | 4/1981 | Slanker | 252/49.5 |
| 4,396,515 | 8/1983 | Sturwold | 252/33.2 |
| 4,419,251 | 12/1983 | Shim et al. | 252/32.7 E |
| 4,436,643 | 3/1984 | Burger et al. | 252/135 |
| 4,486,324 | 12/1984 | Korosec | 252/49.3 |
| 4,540,448 | 9/1985 | Gautier et al. | 148/6.15 R |
| 4,654,155 | 3/1987 | Kipp et al. | 252/32.5 |
| 4,710,232 | 12/1987 | Tahbaz | 134/1 |
| 4,769,178 | 9/1988 | Kenmochi et al. | 252/56 S |
| 4,915,859 | 4/1990 | Kerr et al. | 252/49.5 |
| 5,001,013 | 3/1991 | Sturwold et al. | 428/467 |

*Primary Examiner*—Prince Willis, Jr.
*Assistant Examiner*—Cephia D. Toomer
*Attorney, Agent, or Firm*—Alexander D. Ricci; Steven D. Boyd

[57] ABSTRACT

An emulsion cleaner formulation is provided which is free of toxic or hazardous materials listed under SARA 313. The emulsion cleaner formulation employs a blend of triethanolamine soap of tall oil fatty acid, polyethylene glycol (400) dioleate and polyethylene glycol (400) monooleate as a stabilizing agent. The emulsion cleaner may also include a nonionic surfactant. The emulsion cleaner also includes both oil soluble and water soluble rust inhibitors.

3 Claims, No Drawings

METAL WORKING EMULSION CLEANER

This application is a continuation-in-part of application Ser. No. 08/276,016, filed Jul. 15, 1994, which is a continuation in part of application Ser. No. 08/109,117, filed Aug. 19, 1993, both abandoned.

FIELD OF THE INVENTION

The present invention relates to metal working emulsion cleaners which comprise oil-in-water emulsions used to clean machined metal parts and leave a thin oil film to provide corrosion protection. More particularly, the present invention relates to an emulsion cleaner which is stable as a concentrate, metastable when formed in water, resistant to foaming during use and is free of toxic or hazardous materials.

BACKGROUND OF THE INVENTION

Emulsion cleaners are employed in the metal treatment industry to clean and passivate a metal surface. These type of cleaners are typically oil based and form a macroemulsion when mixed with water. This type of cleaner is typically used to remove gross soil contaminants, fines, and cooling lubricants from machined metal surfaces. The cleaned metal surfaces do not become "water break-free" clean in the traditional sense. This type of "cleaner" leaves an oily film on the surface that provides rust protection.

Emulsion cleaners and clean and passivate treatments sometimes can be interchangeable. Emulsion cleaners usually provide longer term passivation and may be followed by a subsequent step of an oil preservative spray where long times in storage are anticipated. Treated parts may need to remain rust free, while exposed in the manufacturing plant, for from several hours up to thirty days. In order to maintain the rust prevention abilities, these type of cleaners are not rinsed. Commercial emulsion cleaners typically comprising a mixture of oil and emulsifiers which are mixed with water to form an oil-in-water emulsion. In a typical commercial emulsion cleaner, a coupling agent or variety of coupling agents are used to produce a stable concentrate. Conventional coupling agents include butyl cellosolve, butyl carbitol or some similar glycol ether to produce a stable concentrate. Currently, glycol ethers are listed as toxic or hazardous under SARA 313 which makes their use in a commercial setting undesirable.

Typical commercial emulsion cleaners employ oil soluble rust inhibitors which are compatible with the oil phase. Such oil soluble rust inhibitors are relatively easy to incorporate into a stable concentrate. In practice, the emulsion baths tend to be metastable and separate to some extent into a oil rich layer and an aqueous layer. Concentration gradients occur with the oil layer being rich in the oil soluble rust inhibitor and the aqueous phase being depleted in rust inhibiting components. When such separation occurs, the metal surfaces being treated are not adequately protected from rusting.

SUMMARY OF THE INVENTION

It was discovered that an emulsion cleaner which is resistant to foam formation during use, stable as a concentrate, metastable in use, and free of toxic or hazardous materials could be formulated. The emulsion cleaner of the present invention avoids the use of conventional stabilizing coupling agents. The emulsion cleaner of the present invention employs a blend of triethanolamine soap of tall oil fatty acid, polyethylene glycol (400) dioleate and polyethylene glycol (400) monooleate to stabilize a concentrated emulsion cleaner. This blend also facilitates the formation of oil-in-water emulsions when the concentrate is mixed with water prior to use. This formulation avoids the SARA 313 listed glycol ethers that have been commonly used as coupling agents. The formulation of the present invention may also include a nonionic surfactant which enhances the stability of the oil-in-water emulsion bath.

In the formulation of the present invention, in addition to the conventional addition of an oil soluble corrosion inhibitor to the oil phase, a water soluble corrosion inhibitor is added to the concentrate. Thus, upon addition of the concentrate to water, prior to use, both phases of the resulting oil-in-water emulsion will include a corrosion inhibitor.

Thus, the present invention is directed to a combination of a triethanolamine soap of tall oil fatty acid, polyethylene glycol (400) dioleate and polyethylene glycol (400) monooleate as a solubilizing agent in an emulsion cleaner. The formulation of the present invention is an efficacious replacement for conventional glycol ether based coupling agents. The formulation of the present invention may also include a nonionic surfactant which modifies the stability of the working, oil-in-water emulsion bath.

DESCRIPTION OF THE PREFERRED EMBODIMENTS

The present inventor discovered an emulsion cleaner formulation which is stable as a concentrate and metastable as a working solution. The formulation of the present invention is resistant to foam formation during use and is free of toxic or hazardous materials. The formulation of the present invention employs a unique combination of a triethanolamine soap of tall oil fatty acid, polyethylene glycol (400) dioleate, and a polyethylene glycol (400) monooleate as a substitute for a glycol ether coupling agent. This combination provides an enhanced stabilizing effect in a concentrate and the needed metastability in the working solution. The combination is free of toxic or hazardous materials listed under SARA 313. Because of increasingly onerous regulations regarding the use of materials listed as hazardous or toxic under SARA 313, there is a demand for efficacious replacements for SARA 313 listed chemicals in commercial operations.

The emulsion cleaner formulation of the present invention is typically supplied as a concentrate which is diluted with water prior to use. Upon dilution a working solution comprising a milky oil-in-water emulsion forms. The formulation of the present invention provides for stability in the concentrate and metastability in dilute or working solution. By stable, it is meant that the formulation is resistant to separation into an oil layer and a water layer. By metastable, it is meant that the solution exhibits a specific, measurable instability as evidenced by an oil split. The formulation of the present invention has also been found to be resistant to the formation of foam in the working bath. During use, the formulation of the present invention is applied to metal surfaces by spraying, immersion or flow coating. The formation of foam in the working bath can have detrimental effects on bath stability, efficiency of film formation, corrosion protection, and operation of the application equipment.

The emulsion cleaners of the present invention are metastable. Metastable emulsion cleaners are desirable because the limited, controlled separation of the emulsion into an oil layer and a water layer allows the cleaner to lay down a thin film of oil on the surface being treated. This thin oil film, which contains oil soluble corrosion inhibitors, provides the passivation needed to protect the treated surface from rusting. If the emulsion was too stable, no such protective oil/inhibitor film could form. Furthermore, it was found that an unstable emulsion which readily separates to a high degree causes operations problems and does not provide as much corrosion inhibition as a metastable cleaner.

The formulation of the present invention employs the combination of triethanolamine soap of tall oil fatty acid, polyethylene glycol (400) dioleate and polyethylene glycol (400) monooleate, preferably along with an anionic surfactant, to replace a glycol ether coupling agent in an emulsion cleaner. The conventional materials present in an emulsion cleaner concentrate include oil such as naphthenic industrial process oil, sodium petroleum sulfonate, an oil soluble rust inhibitor, and monoethanolamine. The formulation of the present invention also includes a water soluble rust inhibitor.

The stability of the concentrate and metastability of the working dilution of the present invention is a result of the particular combination claimed. That is, the combination of polyethylene glycol (400) dioleate and polyethylene glycol (400) monooleate with an alkoxylated fatty alcohol and monoethanolamine provide the desired stabilities in the concentrate and the working dilution.

In the preferred formulation of the present invention, the triethanolamine soap of tall oil fatty acid comprises from about 0.5 to 10% preferably 2.0% of the concentrate. The polyethylene glycol (400) dioleate and polyethylene glycol (400) monooleate are preferably present in a ratio of 1 to 5 and comprise from about 1 to 4% and preferably 2.4% of the concentrate. The nonionic surfactant is preferably an alkoxylated fatty alcohol such as polyoxyethylene polyoxypropylene ether of an alcohol such as Plurafac RA20 available from BASF. The concentrate of the present invention is typically diluted by adding 1 to 5 parts concentrate and 100 parts water to form the working bath.

A most preferred formulation of the present invention comprises from about 78–82% a naphthenic process oil, from about 5–8% sodium petroleum sulfonate, from about 0.1–0.2% monoethanolamine, from about 2–4% an oil soluble rust inhibitor, and a stabilizing agent to provide for a metastable emulsion in water comprising a combination of from about 0.2–0.5% polyethylene glycol (400) dioleate and from about 1.0–2.0% polyethylene glycol (400) monooleate in a ratio of from about 1 to 5, from about 2–3% triethanolamine, from about 2–4% tall oil fatty acid, and from about 0.1–0.2% a nonionic surfactant. All percentages herein are by weight unless specified otherwise.

In the preferred embodiment, the triethanolamine soap of a tall oil fatty acid is preferably provided by a mixture of tall oil fatty acid such as Westvaco L5 available from Westvaco Corporation, and triethanolamine. The oil phase of the emulsion cleaner can comprise a naphthenic process oil such as Telura 323 available from Witco Chemical Corporation. The preferred emulsion cleaner also includes sodium petroleum sulfonate such as Petrosol M50 available from Penreco. The preferred oil soluble rust inhibitor of the present invention is a mixture of a proprietary barium soap, proprietary high molecular weight organic acids, sodium petroleum sulfonate and a severely hydrotreated heavy naphthenic distillate available as Alox 575 from Alox Corporation. The preferred water soluble rust inhibitor of the present invention is isononanoic acid, a 3,5,5 trimethylhexanoic acid available from American Hoechst Corporation.

The invention is further illustrated by the following specific examples and tables which should not be construed as limiting the invention defined in the claims.

EXAMPLES

Testing was conducted with two commercially available emulsion cleaners and an emulsion cleaner in accordance with the present invention. The testing included corrosion inhibition and stability of the concentrate. The commercial emulsion cleaners tested were Chrysan 418 available from Chrysan Industries and Betz DH-1767 available from Betz Laboratories of Trevose, Pa.

The corrosion inhibition testing comprised wetting cast iron chips resting on filter paper with the emulsion cleaner to be tested, pouring off the cleaner after 30 minutes and exposing the wet chips to the atmosphere for 24 hours. The rating is based on the number of rust spots on the filter paper after removing the chips and on the degree of rust protection based on observation of the chips themselves. Stability was tested by preparing a working concentration of the emulsion cleaner, shaking to mix thoroughly, pouring into a volumetric flask with a neck indexed from 1–10 milliliters, allowed to sit overnight, and recording the milliliters of oil which separated out of the emulsion.

EXAMPLE 1

Table I summarizes the makeup of two formulations tested alongside the commercial emulsion cleaners. Formulation I does not include the combination of polyethylene glycol (400) dioleate, polyethylene glycol (400) monooleate and triethanolamine soap of tall oil fatty acid while formulation 2 is in accordance with the present invention.

TABLE I

| | Formulation | |
|---|---|---|
| | 1 | 2 |
| naphthenic process oil | 78 | 81.3 |
| tall oil fatty acid | 4 | 2 |
| 45% KOH | 2 | — |
| Triethanolamine 99% | 2 | 2 |
| Alox 575 | 3 | 4 |
| Alox 165 | 3 | — |
| Isononanoic Acid | 2 | 2.2 |
| sodium petroleum sulfonate | 5 | 7.0 |
| polyethylene glycol (400) dioleate | — | 0.2 |
| polyethylene glycol (400) monooleate | — | 1.0 |
| Plurafac RA20 | 1 | 0.1 |
| monoethanolamine 99% | — | 0.2 |

Table II summarizes the results of the stability testing and corrosion inhibition testing.

TABLE II

| | Chrysan 418 | Betz DH-1767 | (1) | (2) |
|---|---|---|---|---|
| chip test (paper) | 30S | RS | GR | NRS |
| chip test (chips) | MR | NR | 30S+ | NR |
| layering (mis) | 1.5 | 1.3 | 0.2 | 0.4 |

NR = no chip rusting
MR = mild chip rusting
GR = general chip rusting
NRS = no rust spots on filter paper
6S = 6 rust spots on filter paper Table 2 shows that formulation 2, in accordance with the present invention, provides an emulsion cleaner which is more effective and more stable than current commercial emulsion cleaners.

EXAMPLE 2

Tables III and IV summarize the makeup, stability and corrosion inhibition testing wherein the specific combination of polyethylene glycols, alkoxylated fatty alcohol and monoethanolamine was tested. Table III shows that the ratio of the two polyethylene glycols in combination with the alkoxylated fatty alcohol and monoethanolamine are important in providing the required stability of the concentrate, the metastability of the working dilution and the passivating properties. Table IV shows that the monoethanol amine component does not act as a passivating agent but does affect the oil split desired.

TABLE III

| | DH-1767 | (1) | (2) | (3) | (4) | (5) |
|---|---|---|---|---|---|---|
| Telura 323 | 78 | 78 | 77.5 | 78 | 78 | 78 |
| Westvaco L5 | 4 | 4 | 4 | 4 | 4 | 4 |
| Potassium Hydroxide 45% | 2 | 2 | 2 | 2 | 2 | 2 |
| Triethanolamine, 99% | 2 | 2 | 2 | 2 | 2 | 2 |
| Alox 575 | 3 | 3 | 3 | 3 | 3 | 3 |
| Alox 165 | 3 | 3 | 3 | 3 | 3 | 3 |
| Isononanoic Acid | 2 | 2 | 2 | 2 | 2 | 2 |
| Petrosol M50 | 5 | 5 | 5 | 5 | 5 | 5 |
| PEG 400 DOT | 1 | — | 1 | — | — | — |
| PEG 400 MOT | — | 1 | — | — | — | — |
| Plurafac RA20 | — | — | 0.5 | 1 | 0.5 | — |
| Surfonic N95 | — | — | — | — | 0.5 | — |
| Span 80 | — | — | — | — | — | 1 |
| Layering, mis | 1.3 | 0.9 | 0.6 | 0.2 | 0.2 | 1.5 |
| Chip test (paper) | NRS | MR | MR | GR | GR | NRS |
| Chip test (chips) | NR | 5S | 10S | 30S+ | 30S+ | NR |

NR = no chip rusting
MR = mild chip rusting
GR = general chip rusting
NRS = no rust spots on filter paper
6S = 6 rust spots on filter paper

TABLE IV

| | (A) | (B) | (C) |
|---|---|---|---|
| Telura 323 | 76.9 | 81.5 | 81.3% |
| Westvaco L5 | 3.0 | 2.0 | 2.0 |
| Triethanolamine, 99% | 3.0 | 2.0 | 2.0 |
| Alox 575 | 4.0 | 4.0 | 4.0 |
| Petrosol M-50 | 8.0 | 8.0 | 7.0 |
| Isononanoic Acid | 2.5 | 2.2 | 2.2 |
| PEG 400 DOT | 0.4 | 0.2 | 0.2 |
| PEG 400 MOT | 2.0 | 1.0 | 1.0 |
| Plurafac RA20 | 0.2 | 0.1 | 0.1 |
| Monoethanolamine, 99% | — | — | 0.2 |
| Separation, mis | 0.8–0.9 | 0.6–0.7 | 0.4 |
| Rust protection: | | | |
| Chip | NR | NR | NR |
| Filter paper | SY | TRY | NRS |

SY = Slight yellowing
TRY = Trace yellowing

TABLE IV

EXAMPLE 3

Testing was undertaken on a variety of formulations to evaluate how the stability of the working dilution impacted corrosion inhibition. Table V summarizes the results. Table V shows that for stable emulsions, those having an oil split of about 0.2 mls, no corrosion inhibition is provided. For metastable emulsions, those having an oil split of from about 0.3 mls to 0.7, there is excellent corrosion inhibition. At higher "instabilities", that is those above 0.8 mls oil split, corrosion inhibition decreases and at 1.3 mls split is lost completely.

TABLE V

| | (A) | (B) | (C) | (D) | (E) | (F) |
|---|---|---|---|---|---|---|
| Telura 323 | 78 | 78 | 76.9 | 80.5 | 81.3 | 79.1 |
| Westvaco L5 | 4 | 4 | 3.0 | 2.0 | 2.0 | 2.0 |
| Potassium Hydroxide 45% | 2 | 2 | — | — | — | 1.0 |
| Triethanolamine, 99% | 2 | 2 | 3.0 | 2.0 | 2.0 | 3.0 |
| Alox 575 | 3 | 3 | 4.0 | 4.0 | 4.0 | 3.0 |
| Alox 165 | 3 | 3 | — | — | — | — |
| Petrosol M50 | 5 | 5 | 8.0 | 8.0 | 7.0 | 7.0 |
| Isononanoic Acid | 2 | 2 | 2.5 | 2.2 | 2.2 | 2.5 |
| PEG 400 DOT | — | — | 0.4 | 0.2 | 0.2 | 0.5 |
| PEG 400 MOT | — | — | 2.0 | 1.0 | 1.0 | 2.0 |
| Plurafac RA20 | 1 | 0.5 | 0.2 | 0.1 | 0.1 | 0.3 |
| Surfonic N95 | — | 0.5 | — | — | — | — |
| Monoethanolamine | — | — | — | — | 0.2 | — |
| Oil Split, mis | 0.2 | 0.2 | 0.8 | 0.6 | 0.4 | 1.3 |
| Rust Protection: | | | | | | |
| Chip test (paper) | GR | GR | NR | NR | NR | GR |
| Chip test (chips) | 30+ | 30+ | SY | SY | NRS | 20+ |

NR = no chip rusting
MR = mild chip rusting
GR = general chip rusting
NRS = no rust spots on filter paper
SY = slight yellowing on filter paper
30+ = 30 plus rust spots on the filter paper While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A metal working emulsion passivation and cleaner concentrate comprising from about 78–82% by weight of a naphthenic process oil, from about 5–8% by weight of sodium petroleum sulfonate, from about 0.1 to 0.2 % by weight monoethanolamine, from about 2–4% by weight of an oil soluble rust inhibitor, from about 2–2.5% by weight of a water soluble rust inhibitor, and a stabilizing agent to provide for a metastable emulsion in water comprising a combination of from about 0.2–0.5% by weight of the concentrate of polyethylene glycol (400) dioleate and from about 1.0–2.0% by weight of the concentrate of polyethylene glycol (400) monooleate in a ratio of about 1 to 5, from about 2–3% by weight of the concentrate of triethanolamine, from about 2–4% by weight of the concentrate of tall oil fatty acid, and from about 0.1–0.2% by weight of the concentrate of a nonionic surfactant.

2. The metal working emulsion passivation and cleaner concentrate of claim 1 wherein said nonionic surfactant is a polyoxyethylene polyoxypropylene ether of an alcohol.

3. The metal working emulsion passivation and cleaner concentrate of claim 1 is diluted with water to form an oil-in-water metal working emulsion cleaner.

* * * * *